US006142451A

United States Patent [19]

Lindsey et al.

[11] Patent Number: 6,142,451

[45] Date of Patent: Nov. 7, 2000

[54] APPARATUS AND METHOD FOR CONNECTING FENCE FABRIC TO A SUPPORT STRUCTURE

[75] Inventors: Michael Lindsey, Ontario, Calif.; Bob Ingram, Olney, Ill.; Charlie Larsen, Huntington Beach, Calif.; Gene S. Van Houten, Jr., Woodcrest, Calif.; Kim Chau, Calgary, Canada

[73] Assignee: Master-Halco, Inc., La Habra, Calif.

[21] Appl. No.: 09/113,003

[22] Filed: Jul. 9, 1998

Related U.S. Application Data

[60] Provisional application No. 60/052,059, Jul. 9, 1997.

[51] Int. Cl.[7] ..... B65H 75/40

[52] U.S. Cl. ..... 256/1; 256/32; 242/405.1

[58] Field of Search ..... 256/1, 32, 37, 256/40, 42, 47, 54; 242/405.1, 405.2, 613.3; 140/18, 21, 22, 23, 53

[56] References Cited

U.S. PATENT DOCUMENTS

| | | | |
|---|---|---|---|
| 519,103 | 5/1894 | Advair | 140/53 |
| 625,056 | 5/1899 | Parrish | 140/53 |
| 755,821 | 3/1904 | Wethington | 140/53 |
| 1,655,065 | 1/1928 | Le Baron | 242/405.2 |
| 2,470,212 | 5/1949 | Carlson | 242/405.1 |
| 3,133,683 | 5/1964 | Deacon, Sr. | 242/613.3 X |
| 3,371,911 | 3/1968 | Parisien | 256/54 X |
| 3,576,297 | 4/1971 | Cowart, Jr. | 242/405.2 |
| 3,626,495 | 12/1971 | Bastian, Jr. | 242/405.2 |
| 4,779,816 | 10/1988 | Varlet | 242/405.1 |

*Primary Examiner*—Lynn H. Browne
*Assistant Examiner*—John R. Cottingham
*Attorney, Agent, or Firm*—Knobbe, Martens, Olson & Bear, LLP

[57] ABSTRACT

An apparatus and method for connecting fence fabric to a support structure includes a tool with an elongated body member with notches at opposite ends. The notches are configured to allow a line to be securely wrapped around the tool. The tool is sized to allow it to fit through an opening located in the fence fabric. The tool is preferably constructed of steel and it includes one or more openings extending through the elongated member to facilitate attaching the line to the tool. The line is used to couple the fence fabric to the support structure.

1 Claim, 4 Drawing Sheets

APPARATUS AND METHOD FOR CONNECTING FENCE FABRIC TO A SUPPORT STRUCTURE

CROSS-REFERENCE TO RELATED APPLICATIONS

The present application claims the benefit of provisional application Serial No. 60/052,059 which was filed on Jul. 9, 1997.

BACKGROUND OF THE INVENTION

1. Field of the Invention

The present invention relates in general to fencing and, in particular, to an apparatus and method for connecting fence fabric to a support structure.

2. Description of Related Art

Fences are conventionally used for a wide range of applications, such as enclosing or bordering fields or yards. Fences are commonly constructed of posts and wires or wood, and they may be used to prevent entrance, mark a boundary or create an enclosure for animals.

Fences constructed from wood must be frequently repaired or replaced because the wood decomposes or decays. In particular, wooden fence posts quickly deteriorate because a portion of the post is inserted into the ground. When the wood begins to rot, it rapidly loses its strength and the structural integrity of the fence decreases. Thus, wooden fences involve significant maintenance and repair costs.

Conventional fences are also constructed with metal components such as steel fence posts and wires. Fences commonly include one or more openings which allow objects to traverse the fence. These openings typically include a door or gate to control the movement of objects from one side of the fence to the other. The gate is frequently connected to the fence by one or more hinges. An example of a portion of a conventional gate is shown in FIG. 1. The conventional gate 10 includes a support post 12, wires 14 in the form of chain link (commonly referred to a fence fabric) and a gate frame 15. One edge of the fence fabric 14 is typically connected to the gate frame 15 by a plurality of wire ties 16.

As shown in FIGS. 2 and 3, a conventional wire tie 16 includes a generally straight, elongated body 20 with a hooked portion 22 located proximate a first end 24 of the body before it is used to attach the fence fabric 14 to the fence post 12. The elongated body 20 is generally about 6.5 inches (16.5 cm) in length, the hooked portion 22 is generally bent at about an angle θ of about 30° with respect to the body, and the hooked portion is about 1.0 inch (2.5 cm) in length.

As known in the prior art, the hooked portion 22 of the tie 16 is inserted through an opening 28 in the fence fabric 14, and the hooked portion catches or ensnares a portion of the fence fabric. The elongated body 20 is then bent around the gate frame 15 such that the second end 26 of the wire tie is positioned near the first end 24. The second end 26 of the wire tie 16 is also inserted through the opening 28 in the fence fabric 14 and the second end is deformed or bent so that this end of the wire tie also catches or ensnares a portion of the fence fabric. Thus, the wire tie 16 connects the fence fabric 14 to the gate frame 15.

Wire ties 16 used to connect fence fabric 14 to fence posts 12 are conventionally constructed of aluminum or steel. Disadvantageously, steel wire ties are troublesome to use because they are very difficult to bend. Thus, tools such as pliers or other specially developed tools are frequently used to bend the steel wire ties. The installation of the steel wire ties, even with the use of tools, is awkward and laborious. In addition, because the steel wire ties require a significant amount of time to install, this increases the costs and expenses of constructing the fence.

Aluminum wire ties, on the other hand, are relatively simpler to install because they are easier to bend, but tools such as pliers or other specially developed tools are still typically used to install the aluminum wire ties. The installation of the aluminum wire ties is also time consuming and awkward. Aluminum wire ties, however, have the significant disadvantage that, because aluminum is very malleable, various stresses or forces on the fence may deform one or more of the wire ties. Thus, openings or holes may be easily formed between the fence fabric and the fence post. This is particularly disadvantageous when the fencing is used to create an enclosure for animals, such as a kennel. An animal, for example, can create such an opening by leaning into or pushing against the walls of the enclosure. Once the opening exists, the animal can escape or become entangled in the fence and, as a result, can injure itself or others.

SUMMARY OF THE INVENTION

A need therefore exists for an apparatus and method that allows fence fabric to be quickly and easily attached to a support surface, without the above-described disadvantages.

One aspect of the present invention is a tool for attaching fence fabric to a support structure. The tool includes an elongated body with a first side, a second side, a first end and a second end. The first and second ends include notches and the tool is sized to fit through an opening in a fence fabric. Desirably, the notches allow a line to be wrapped around the elongated body of the tool.

Another aspect of the present invention is a method of using a tool to connect fence fabric to a support structure. The tool includes an elongated body and a line is wrapped longitudinally around the elongated body. One end of the line is attached to a support point and the line contacts the fence fabric and the support structure. Preferably, the line is inserted through an opening in the fence fabric and line is wrapped around the support structure, and this step is repeated as desired. The line is then attached to another support point so that the fence fabric is securely connected to the support structure.

Advantageously, the present invention is easy to manufacture and simple to use because, in contrast to conventional wire ties, the present invention allows the installer to "stitch" the fabric to the support structure which results in a secure connection between the fence fabric and the support structure. Thus, a strong fence can be easily created by using the present invention to attach the fence fabric to the support structure.

The present invention is particularly advantageous because the tool allows the fence fabric to be connected to the support structure in the field. This is true because of the light weight and manageable size of the tool. Additionally, the tool may be readily used at the factory to connect the fence fabric to the support structure. For example, the tool may be used at the factory to attach fence fabric to a frame to create a gate.

Further, the present invention does not require the use of any additional tools to attach the fence fabric to the support structure. Instead, only the simple "stitching" motion is used to connect the fence fabric to the support structure. This stitching, which allows the fence fabric to be connected to the support structure at a plurality of different locations with a single line, creates a strong fence system so that a force necessary to create an opening between the fence fabric and the support structure is much greater than the force needed to produce an opening in a fence assembled using conventional aluminum wire ties. For example, if the fence fabric is connected to the support structure at a plurality of locations by a single line, the line or fence fabric must be cut or broken to create an opening between the fence fabric and the support structure. On the other hand, if conventional aluminum wire ties are used, the malleable aluminum wire tie must only be deformed enough to allow the fence fabric to detach from the wire tie. Because it requires much more force to cut or break the line or fence fabric than bend the aluminum wire tie, the present invention creates a much stronger fence. Applicant believes the connection between the fence fabric and the support structure is significantly stronger with a fence created with the present invention than a fence created with conventional aluminum wire ties. Thus, the present invention provides a fence system with much greater safety and security.

The tool of the present invention is efficient and economic to use because it reduces installation time. In particular, a user, whether or not skilled in the fencing industry, can easily use the present invention to attach fence fabric to a support structure. In contrast, conventional wire ties require significant skill to correctly attach the fence fabric to the support structure and this skill often requires an extended time to develop. The tool of the present invention, however, is user friendly and it allows persons of various skill levels to quickly and simply attach the fence fabric to a support structure. Advantageously, the present invention results in significant time savings for persons of different skill levels using the tool.

Further aspects, features and advantages of the present invention will become apparent from the following detailed description of the preferred embodiments.

BRIEF DESCRIPTION OF THE DRAWINGS

The appended drawings contain figures of conventional wire ties, which were discussed above, and figures of preferred embodiments of the present invention. The above-mentioned features of the present invention, as well as other features, will be described in connection with these preferred embodiments; however, the illustrated embodiments are intended to illustrate and not to limit the invention. The drawings contain the following figures.

DETAILED DESCRIPTION OF THE PREFERRED EMBODIMENT

Figure 10:
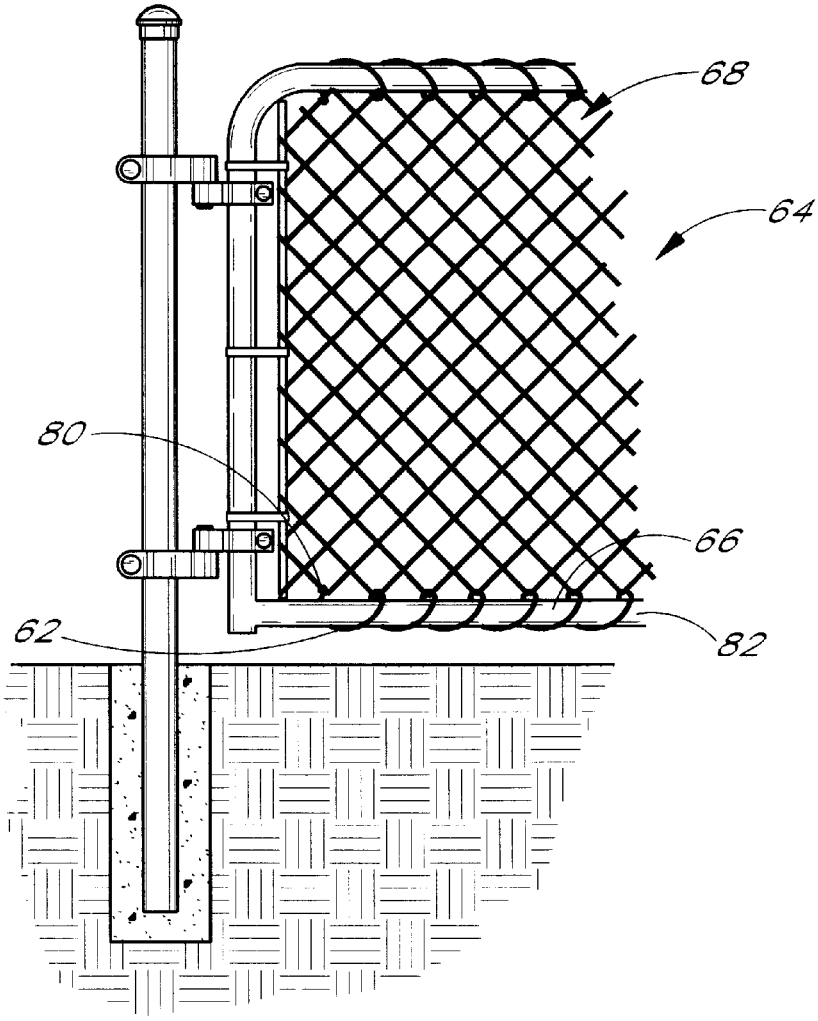
FIG. 10 is a side view of a gate, illustrating fence fabric connected to a gate frame by a line.

The present invention involves a lacing tool 30 which is used to attach fence fabric 64 to a support structure 66. As seen in FIG. 10, the fence fabric 64 preferably comprises chain link, but any type of suitable wires or fence fabric may be used. The support structure 66 shown in FIG. 10 is the frame of a gate, but any desired object or structure that can support the fence fabric 64 may be used. For example, but without limitation, the support structure 66 can be a fence post, fence frame, wall or the like.

Additionally, to assist in the description of the lacing tool 30, words such as upward and downward are used to describe the accompanying figures. It will be appreciated, however, that the present invention can be located in a variety of desired positions—including various angles, sideways and even upside down. A detailed description of the lacing tool 30 follows.

Figure 1:
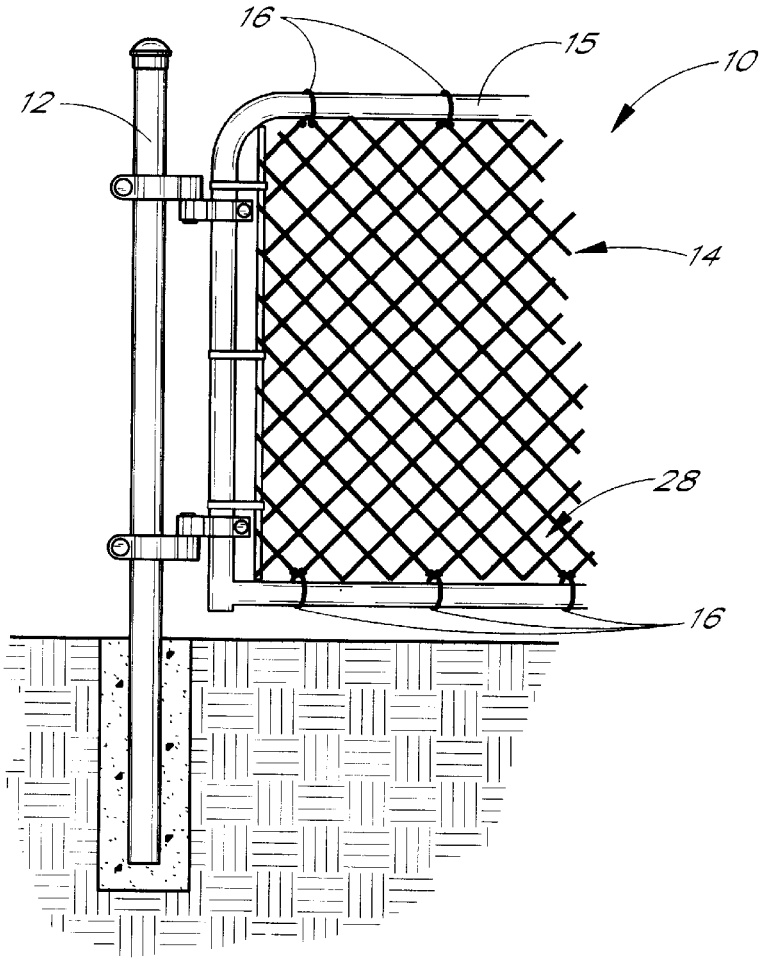
FIG. 1 (PRIOR ART)
FIG. 1 is a side view of a conventional gate, illustrating fence fabric connected to the gate frame by conventional aluminum wire ties.
Figure 2:
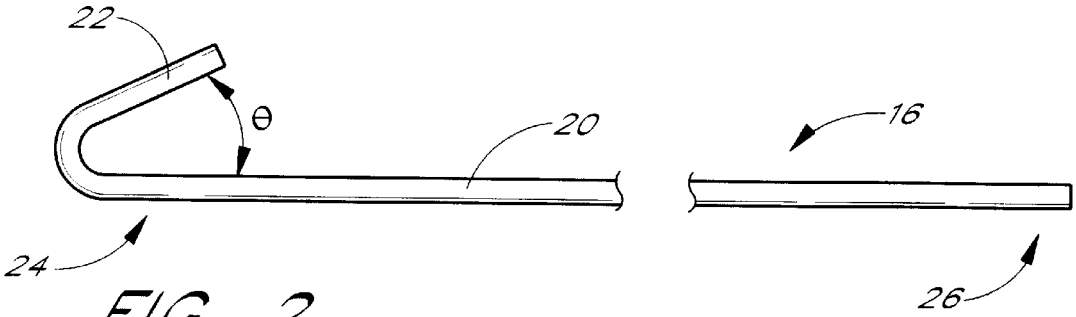
FIG. 2 (PRIOR ART)
FIG. 2 is a side view of conventional aluminum wire tie, illustrating a hook located at one end.
Figure 3:
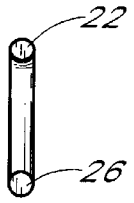
FIG. 3 (PRIOR ART)
FIG. 3 is an end view of the conventional aluminum wire tie shown in FIG. 2.
Figure 4:
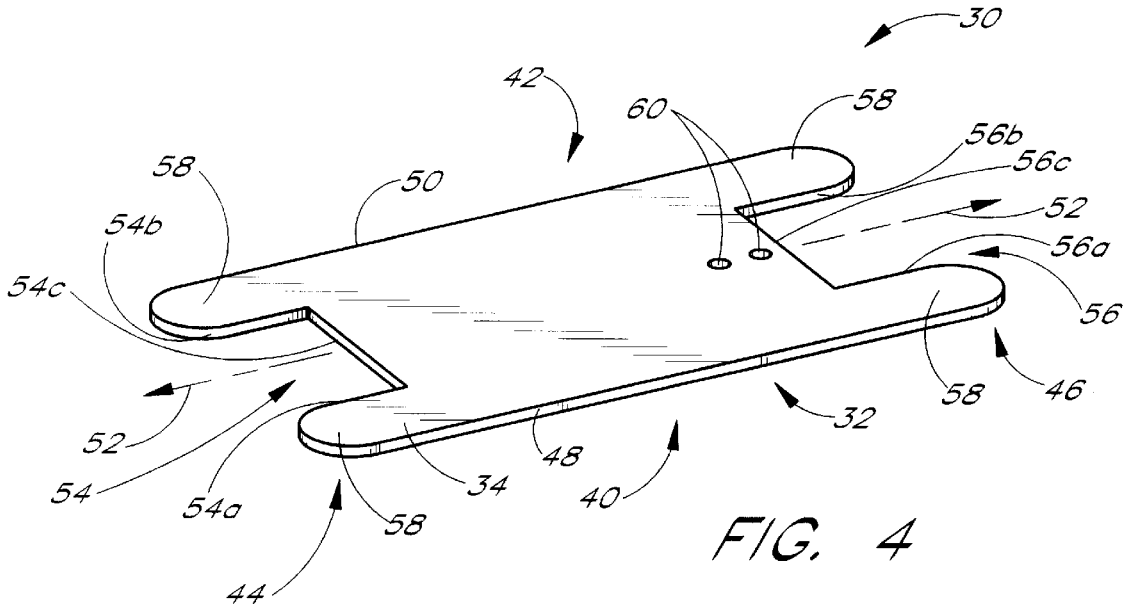
FIG. 4 is a perspective view of the lacing tool in accordance with a preferred embodiment of the present invention.
Figure 5:
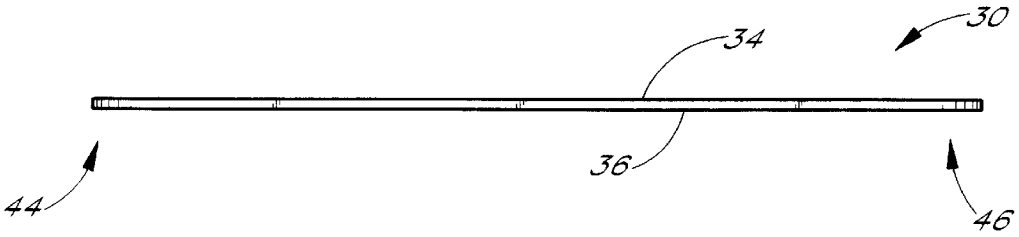
FIG. 5 is a side view of the lacing tool shown in FIG. 4.
Figure 6:
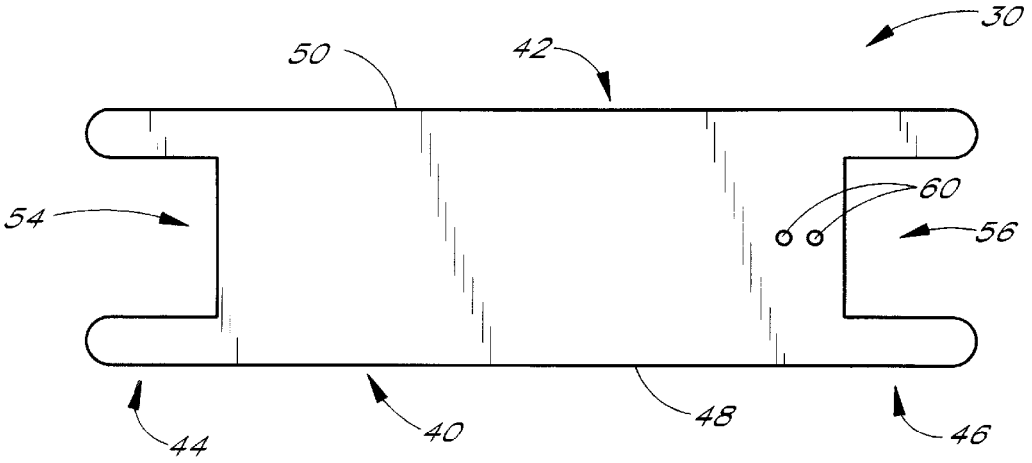
FIG. 6 is a top view of the lacing tool shown in FIG. 4.

FIGS. 4–6 illustrate the lacing tool 30 constructed in accordance with a preferred embodiment of the present invention. The lacing tool 30 includes an elongated body member 32 with a generally planar upper surface 34 and a generally planar lower surface 36. The upper 34 and lower surfaces 36 are generally parallel to one another such that the tool has a generally constant thickness. The tool preferably has a thickness of about ¼ of an inch, but it may be thicker or thinner. It will be appreciated that the surfaces 34 and 36 can also be, for example, angled, curved, flat, or have any desired shape or configuration.

The elongated body member 32 of the tool 30 includes a first side 40, a second side 42, a first end 44 and a second end 46. The first side 40 and second side 42 preferably have generally straight outer edges 48 and 50, respectively, which are generally aligned with a longitudinal axis 52 extending approximately through the center of the elongated body member 32, but the sides may also be curved or have any desired shape. The edges 48 and 50 are desirably slightly rounded for safety, but the edges may have other shapes and sizes.

The length of the elongated body member 32 preferably ranges from about 2 inches (5 cm) to about 12 inches (30 cm) and more preferably the body is about 7 inches (18 cm) in length, but it will be appreciated that the body can have any desired length depending, for example, upon the use of the tool. The width of elongated body member 32 preferably ranges from about 1 inch (2.5 cm) to about 3 inches (8 cm), and more preferably the body is about 2 inches (5 cm) in width, but the size and configuration of the elongated body 32 may vary depending, for example, upon the size of the opening in the fence fabric. The lacing tool 30 is preferably constructed from steel, but wood, plastic, and other materials with suitable characteristics may also be used.

The first end 44 and the second end 46 of the elongated body member 32 include notches 54 and 56, respectively, which assist in attaching a line 62 (shown in FIG. 7) to the elongated body member. The first notch 54 has side walls 54*a*, 54*b* and a bottom wall 54*c*, and the second notch 56 includes side walls 56*a*, 56*b* and a bottom wall 56*c*. The first and second notches 54 and 56 are preferably "U"-shaped with a depth between about ½ inch (1 cm) and about 2 inches (5 cm), more preferably about 1 inch (2.5 cm), and a width between about ½ inch (1 cm) and about 2 inches (5 cm), more preferably about 1.25 inches (3 cm), but the notches 54 and 56 may also be larger or smaller depending upon the size and arrangement of the elongated body 32. It will be appreciated that the notches 54 and 56 may have various configurations such as "V" or "W" shapes, include teeth or ridges to engage the line 62, have asymmetrical configurations, etc.; and the first notch may have a different shape and/or size than the second notch.

The four outwardly extending ends or corners 58 of the body 32 are preferably rounded for safety and, more preferably, the ends are rounded with a radius of curvature of about 3/16 of an inch (0.5 cm), but the ends may have a different radius of curvature depending for example upon the size of the tool 30 and the size of the notches 54 and 56. Additionally, the corners 58 may be square, pointed or have any other desired shape.

The tool 30 includes two openings 60 located proximate the second end 46 of the elongated body 32. The openings 60 are configured to receive one end of the line 62 to facilitate wrapping the line about the tool. The first opening is located about 1¼ inches (3.2 cm) from the end 46 of the tool 30 and the openings are spaced apart by a distance of about ⅜ of an inch (1.0 cm), but the openings can be spaced any desired distance apart and at any distance from the end of the tool. It will be appreciated that any number of openings 60 may be used and the openings may be located in any desired portion of the body 32, including either or both ends.

Figure 7:
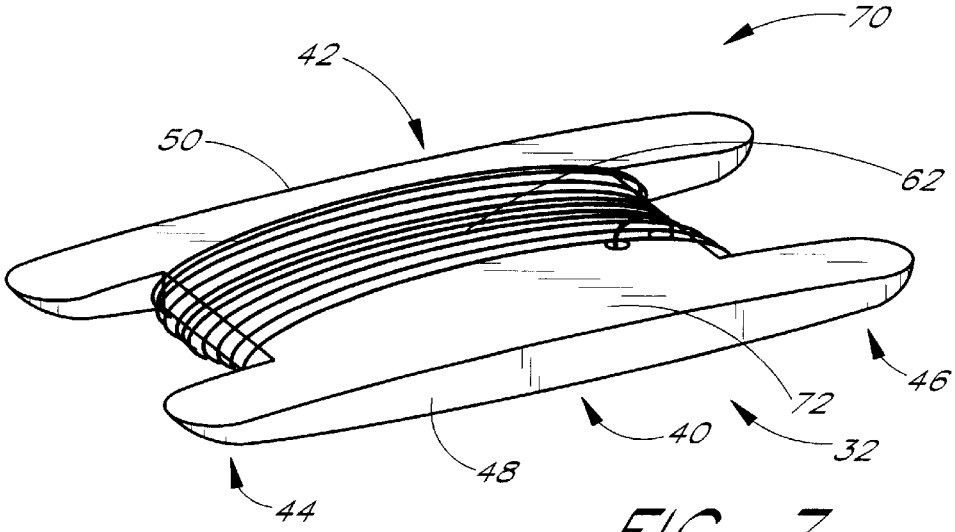
FIG. 7 is a perspective view of the lacing tool in accordance with another preferred embodiment of the present invention, illustrating a line wrapped around the tool.
Figure 8:
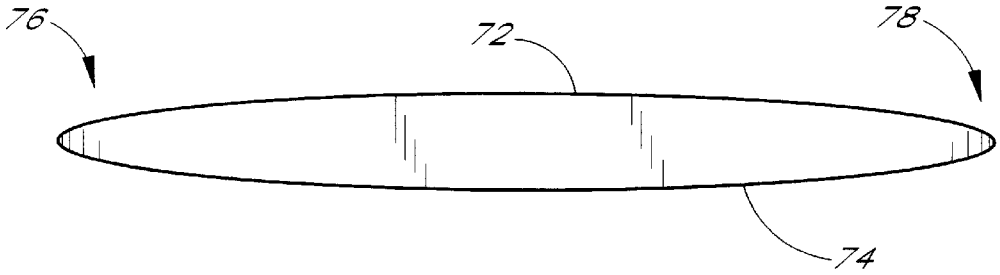
FIG. 8 is a side view of the lacing tool shown in FIG. 7.
Figure 9:
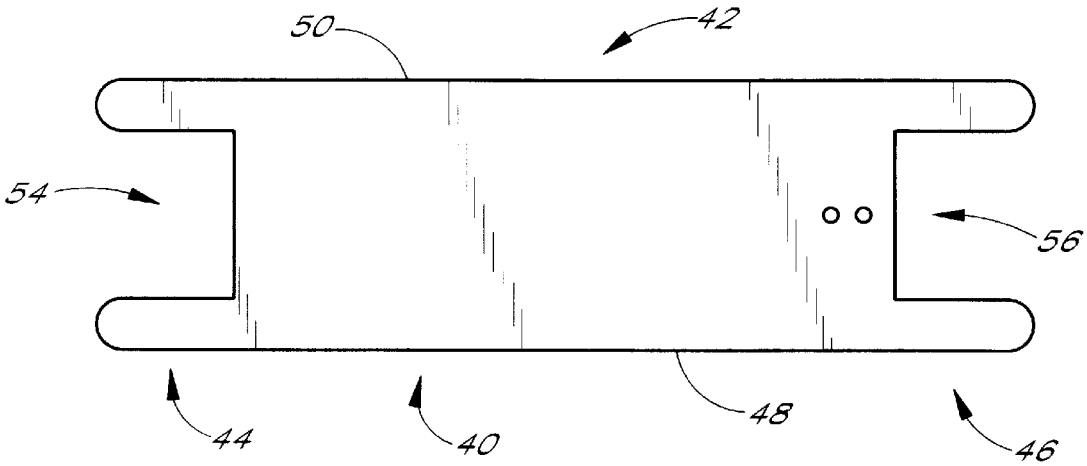
FIG. 9 is a top view of the lacing tool shown in FIG. 7.

As shown in FIGS. 7–9, an alternative embodiment of the tool 70 includes an upper surface 72 and a lower surface 74 which are curved outwardly such that the thickness of the tool varies. Preferably, near the mid-point of the elongated body 32, the tool 70 has a thickness between about ¼ inch (0.6 cm) and about 2 inches (5 cm), and more preferably the tool has a thickness of about 1 inch (2.5 cm). The ends 44 and 46 of the tool 70 preferably range in thickness from about ⅛ inch (0.3 cm) to about 1 inch (2.5 cm), and more preferably the ends of the tool have a thickness of about ¼ inch (0.6 cm). It will be understood that the tool 70 may have any desired configuration, provided the tool can be fit through an opening in the fence fabric 64.

As seen in FIG. 7, line 62 is wrapped around the elongated body 32 along the longitudinal axis 52. The line 62 can be wire, string, cable, chain or the like which is suitable for attaching fence fabric 64 to the support structure 66. Preferably, the line 62 is 16 gauge wire, but the thickness and strength of the wire may vary, for example, according to the desired use of the tool and/or desired strength of the fence. The tool 30 is advantageously configured to support 75 feet or more of the line 62. Thus, the tool 30 allows large portions of the fence fabric 64 to be connected to support structure 66. It will be understood that smaller sections of fence fabric 64 can be connected to support structures 66 by cutting the line 62 at the desired length.

As seen in FIG. 10, the line 62 is used to attach fence fabric 64 to a support structure 66 comprising the frame of a gate. The fence fabric 64 is preferably standard chain link fence which includes a plurality of generally diamond shaped openings 68 which have a width and a height of about 2½ inches, but the fence fabric may comprise other types of known fencing with differently sized openings. Advantageously, the tool 30 allows fence fabric to be quickly and easily attached to the gate frame and, because the fence fabric is securely connected to the gate frame, this assists in preventing openings from being created in between the gate frame and the fence fabric. This is particularly advantageous when the tool 30 is used to create an enclosure for animals such as a pen or kennel because the secure connection helps prevent the animals from creating an opening in the kennel—which helps prevent animals from escaping and/or injuring themselves or others.

The lacing tool 30, 70 is preferably constructed by stamping the elongated body 32 out of a piece of steel, but the tool may also be cut or formed into the desired shape and other types of metal may be used. Desirably, elongated body 32, first side 40, second side 42, outer edges 48 and 50, and notches 54 and 56 are created as part of a single step when the tool is stamped from a piece of metal, but multiple steps may also be used. It will be appreciated that the tool 30, 70 may also be constructed of wood, plastic or other known materials with suitable characteristics.

In use, line 62 is wrapped around the elongated body member 32 and the free end of the wire is attached to a support point 80. As seen in FIG. 10, the support point 80 is a portion of the fence fabric 64, but the support point may also comprise a portion of the support structure 66 or other support member. The line 62 is then used to attach the fence fabric 64 and support structure 66. Preferably, the line 62 is inserted through one or more openings 68 in the fence fabric 64 and the line is wrapped around or supported by the support structure 66. It will be understood that the line 62 can be wrapped around or placed in contact with the fence fabric 64 and support structure 66 any number of desired times and in any desired configuration. For example, the line 62 may be inserted through each adjacent opening 68 along an edge of the fence fabric 64, or one or more of the openings may be skipped. Desirably, the line 62 is "woven" through the openings 68 and around the support structure 66 to "stitch" the fence fabric to the support structure. When the desired amount of fence fabric 64 is connected to the support structure 66, the line 62 is cut and this end of the line is fastened to a support point 82. The support point 82 shown in FIG. 10 is a portion of the support structure 66, but it can also be a portion of the fence fabric 64 or other fixed location. Further, the support point 82 could be the same as support point 80.

Advantageously, the lacing tool 30, 70 of the present invention does not require the use of conventional wire ties in order to create a strong attachment between the fence fabric and the support structure. In contrast, the tool 30, 70 allows the fence fabric 64 to be "stitched" to the support structure 66, which creates a strong attachment of the fence fabric to the support structure. Additionally, the light weight and relatively small size of the tool 30, 70 allows the tool to be used with ease while performing a fence assembly in the field, but the tool can also be used in the factory.

The line 62 can be readily attached to the tool 30, 70 by inserting a first end of the through one or more of the openings 60 and then wrapping the line about the elongated body. The notches 54 and 56 advantageously help position the line 62 in the desired location. This allows the line 62 to be readily attached to the tool 30, 70 at the factory or in the field. Additionally, persons of different skill levels, whether a novice or expert, can attach the line 62 to the tool 30, 70. Further, the tool 30, 70 can be readily reused by simply attaching more line 62 to the tool.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A method of attaching fence fabric to a support structure, said fabric being formed by a plurality of strands creating a plurality of openings bounded by the strands, the method comprising:

providing a tool with a generally flat, generally elongated body having a width sized to fit through one or more openings in the fence fabric, said body having a notch formed on opposite ends, the tool including a line wrapped around the elongated body, with the line extending into said notches and with one end of the line attached to a support point on the body;

repeatedly inserting the tool through one or more openings in the fence fabric and repeatedly wrapping the line around the support structure; and attaching another end of the line to a second support point to thereby secure the fabric to the support structure.

* * * * *